US006604248B1

(12) United States Patent
Brown

(10) Patent No.: US 6,604,248 B1
(45) Date of Patent: Aug. 12, 2003

(54) PERSONAL PROTECTIVE SYSTEM

(76) Inventor: Jerry L. Brown, P.O. Box 1824, Lithonia, GA (US) 30058

( * ) Notice: Subject to any disclaimer, the term of this patent is extended or adjusted under 35 U.S.C. 154(b) by 0 days.

(21) Appl. No.: 09/754,899

(22) Filed: Jan. 5, 2001

(51) Int. Cl.[7] ..... A41D 13/00
(52) U.S. Cl. ..... 2/456; 2/69; 2/84
(58) Field of Search ..... 2/457, 456, 458, 2/2.11, 2.14–2.16, 2.17, 410, 6.2, 69.5, 69, 84, 93, 901, 81; 362/103, 108

(56) References Cited

U.S. PATENT DOCUMENTS

| | | | | | |
|---|---|---|---|---|---|
| 2,239,223 | A | | 4/1941 | Gilman | |
| 2,709,667 | A | * | 5/1955 | Grubb et al. | 2/458 |
| 3,100,897 | A | * | 8/1963 | Langer | 2/69 |
| 3,113,320 | A | * | 12/1963 | Cherowbrier et al. | 2/81 |
| 4,089,065 | A | | 5/1978 | Mcgee | |
| 4,253,198 | A | * | 3/1981 | Estabrook | 2/82 |
| 4,453,271 | A | | 6/1984 | Donzis | |
| 4,458,680 | A | * | 7/1984 | Childers et al. | 2/456 |
| 4,783,853 | A | | 11/1988 | Zuber | |
| 4,847,914 | A | * | 7/1989 | Suda | 2/456 |
| 4,890,336 | A | * | 1/1990 | Worton | 2/79 |
| 5,088,115 | A | * | 2/1992 | Napolitano | 2/69 |
| 5,309,571 | A | * | 5/1994 | Huang | 2/81 |
| 5,337,418 | A | | 8/1994 | Kato et al. | |
| 5,357,635 | A | * | 10/1994 | Lemoine | 2/84 |
| 5,421,326 | A | * | 6/1995 | Rankin et al. | 2/69 |
| D379,110 | S | | 5/1997 | Neustater et al. | |
| 5,652,966 | A | * | 8/1997 | Reinert | 2/457 |
| 5,690,411 | A | * | 11/1997 | Jackman | 362/103 |
| 5,918,314 | A | * | 7/1999 | Moses | 2/79 |
| 5,973,602 | A | * | 10/1999 | Cole | 2/93 |
| 6,032,285 | A | * | 3/2000 | Densen | 2/456 |
| 6,047,413 | A | * | 4/2000 | Welchel et al. | 2/457 |

* cited by examiner

*Primary Examiner*—Gloria M. Hale
*Assistant Examiner*—Tejash Patel

(57) ABSTRACT

A personal protective system for providing additional protection from hostile environments resulting from natural disasters. The personal protective system includes a main garment member adapted for covering and substantially conforming to the legs, torso, and arms of a user and having a padding portion and a covering portion the covering portion enveloping the padding portion such that the padding portion and the covering portion cover the legs, torso, and arms of the user when the user wears the main garment member whereby the main garment member is adapted for providing protection against flying debris, a pair of boot members each being integrally attached to an associated leg portion of said main garment member and being adapted for covering the feet and ankles of the user when the user wears the main garment member, and a hood member having a visor portion and a hood portion adapted for substantially covering the temporal, occipital, parietal and sagittal portions of the head along with the sides and nape of the neck of the user and adapted for providing protection against flying debris.

13 Claims, 3 Drawing Sheets

PERSONAL PROTECTIVE SYSTEM

BACKGROUND OF THE INVENTION

1. Field of the Invention

The present invention relates to protective garments and more particularly pertains to a new personal protective system for providing additional protection from hostile environments resulting from natural disasters.

2. Description of the Prior Art

The use of protective garments is known in the prior art. More specifically, protective garments heretofore devised and utilized are known to consist basically of familiar, expected and obvious structural configurations, notwithstanding the myriad of designs encompassed by the crowded prior art which have been developed for the fulfillment Of Countless objectives and requirements.

Known prior art includes U.S. Pat. No. 4,453,271; U.S. Pat. No. 5,337,418; U.S. Pat. No. 4,783,853; U.S. Pat. No. 4,089,065; U.S. Pat. No. 2,239,223; and U.S. Pat. No. Des. 379,110.

While these devices fulfill their respective, particular objectives and requirements, the aforementioned patents do not disclose a new personal protective system. The inventive device includes a main garment member adapted for covering and substantially conforming to the legs, torso, and arms of a user and having a padding portion and a covering portion the covering portion enveloping the padding portion such that the padding portion and the covering portion cover the legs, torso, and arms of the user when the user wears the main garment member whereby the main garment member is adapted for providing protection against flying debris, a pair of boot members each being integrally attached to an associated leg portion of said main garment member and being adapted for covering the feet and ankles of the user when the user wears the main garment member, and a hood member having a visor portion and a hood portion adapted for substantially covering the temporal, occipital, parietal and sagittal portions of the head along with the sides and nape of the neck of the user and adapted for providing protection against flying debris.

In these respects, the personal protective system according to the present invention substantially departs from the conventional concepts and designs of the prior art, and in so doing provides an apparatus primarily developed for the purpose of providing additional protection from hostile environments resulting from natural disasters.

SUMMARY OF THE INVENTION

In view of the foregoing disadvantages inherent in the known types of protective garments now present in the prior art, the present invention provides a new personal protective system construction wherein the same can be utilized for providing additional protection from hostile environments resulting from natural disasters.

The general purpose of the present invention, which will be described subsequently in greater detail, is to provide a new personal protective system apparatus and method which has many of the advantages of the protective garments mentioned heretofore and many novel features that result in a new personal protective system which is not anticipated, rendered obvious, suggested, or even implied by any of the prior art protective garments, either alone or in any combination thereof.

To attain this, the present invention generally comprises a main garment member adapted for covering and substantially conforming to the legs, torso, and arms of a user and having a padding portion and a covering portion the covering portion enveloping the padding portion such that the padding portion and the covering portion cover the legs, torso, and arms of the user when the user wears the main garment member whereby the main garment member is adapted for providing protection against flying debris, a pair of boot members each being integrally attached to an associated leg portion of said main garment member and being adapted for covering the feet and ankles of the user when the user wears the main garment member, and a hood member having a visor portion and a hood portion adapted for substantially covering the temporal, occipital, parietal and sagittal portions of the head along with the sides and nape of the neck of the user and adapted for providing protection against flying debris.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal protective system apparatus and method which has many of the advantages of the protective garments mentioned heretofore and many novel features that result in a new personal protective system which is not anticipated, rendered obvious, suggested, or even implied by any of the prior art protective garments, either alone or in any combination thereof.

It is another object of the present invention to provide a new personal protective system which may be easily and efficiently manufactured and marketed.

It is a further object of the present invention to provide a new personal protective system which is of a durable and reliable construction.

An even further object of the present invention is to provide a new personal protective system which is susceptible of a low cost of manufacture with regard to both materials and labor, and which accordingly is then susceptible of low prices of sale to the consuming public, thereby making such personal protective system economically available to the buying public.

Still yet another object of the present invention is to provide a new personal protective system which provides in the apparatuses and methods of the prior art some of the advantages thereof, while simultaneously overcoming some of the disadvantages normally associated therewith.

Still another object of the present invention is to provide a new personal protective system for providing additional protection from hostile environments resulting from natural disasters.

Yet another object of the present invention is to provide a new personal protective system which includes a main garment member adapted for covering and substantially conforming to the legs, torso, and arms of a user and having a padding portion and a covering portion the covering portion enveloping the padding portion such that the padding portion and the covering portion cover the legs, torso, and arms of the user when the user wears the main garment member whereby the main garment member is adapted for providing protection against flying debris, a pair of boot members each being integrally attached to an associated leg portion of said main garment member and being adapted for covering the feet and ankles of the user when the user wears the main garment member, and a hood member having a visor portion and a hood portion adapted for substantially covering the temporal, occipital, parietal and sagittal portions of the head along with the sides and nape of the neck of the user and adapted for providing protection against flying debris.

Still yet another object of the present invention is to provide a new personal protective system that is fire resistant.

Even still another object of the present invention is to provide a new personal protective system that provides both visual and aural indications of the users location.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
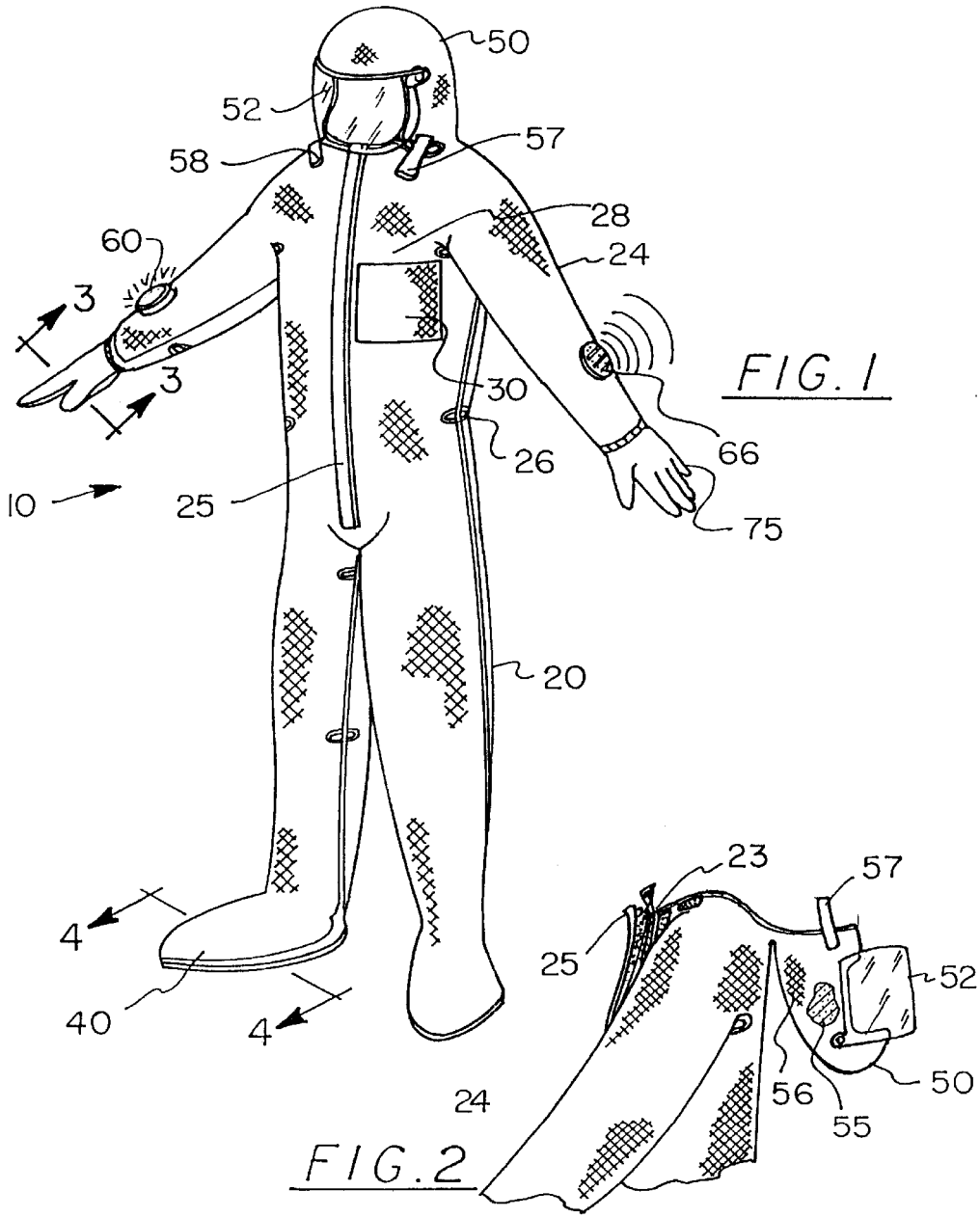
FIG. 1 is a schematic perspective view of a new personal protective system according to the present invention.
FIG. 2 is a schematic detail view of the present invention showing the chest portion and hood member.
Figure 3:
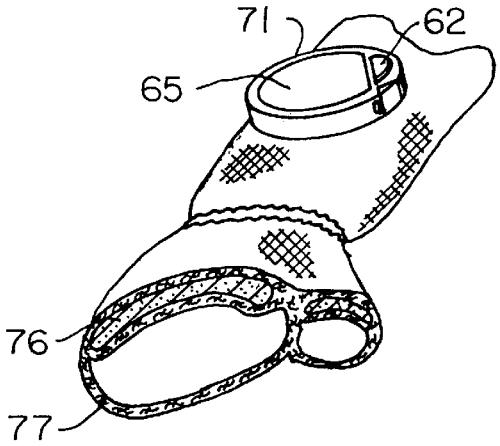
FIG. 3 is a schematic cross-sectional view of the present invention taken along line 3—3 of FIG. 1.
Figure 4:
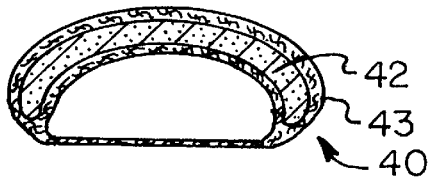
FIG. 4 is a schematic cross-sectional view of the present invention taken along line 4—4 of FIG. 1.
Figure 5:
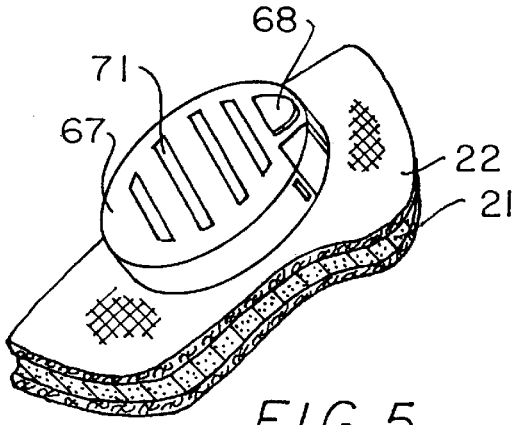
FIG. 5 is a schematic cross-sectional view of the present invention showing the main member and sound assembly.
Figure 6:
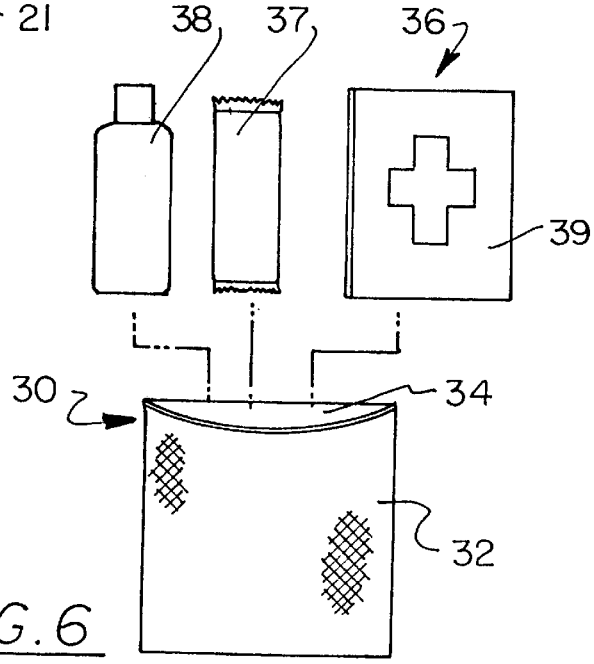
FIG. 6 is a schematic front view of the chest pouch assembly of the present invention.
Figure 7:
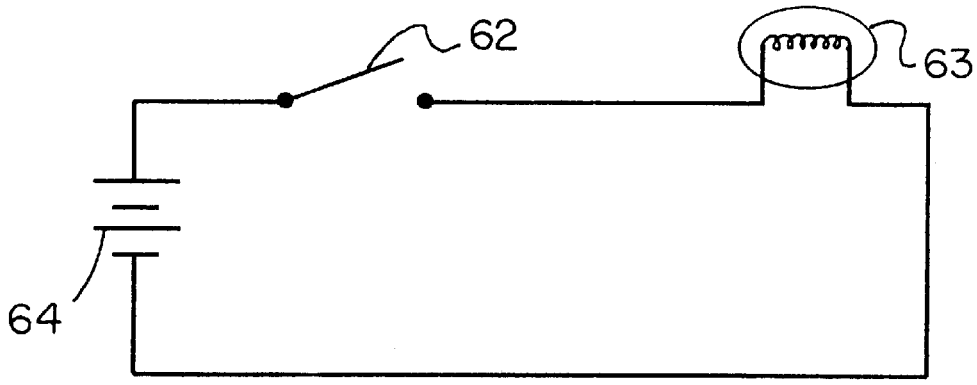
FIG. 7 is a schematic circuit diagram of the light assembly of the present invention.
Figure 8:
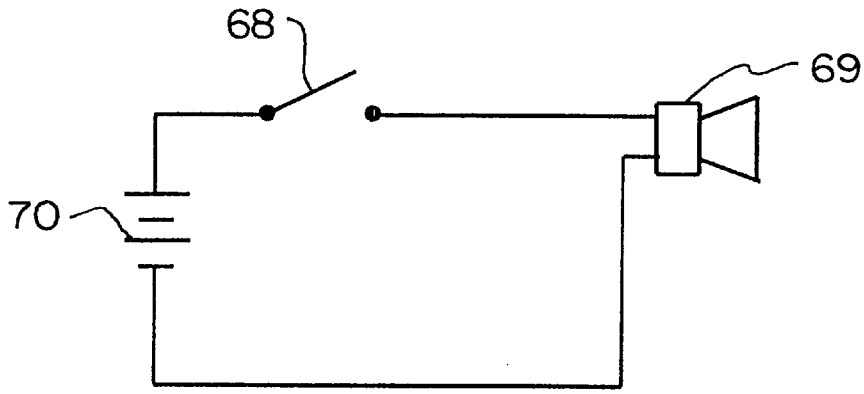
FIG. 8 is a schematic circuit diagram of the sound assembly of the present invention.

With reference now to the drawings, and in particular to FIGS. 1 through 8 thereof, a new personal protective system embodying the principles and concepts of the present invention and generally designated by the reference numeral 10 will be described.

As best illustrated in FIGS. 1 through 8, the personal protective system 10 generally comprises a main garment member 20, a pair of boot members 40, a hood member 50, a light assembly 60, a sound assembly 66, and a pair of glove members 77.

The main garment member 20 is designed for covering and substantially conforming to the legs, torso, and arms of a user. The main garment member 20 includes a padding portion 21 and a covering portion 22. The covering portion 22 envelops the padding portion 21 such that the padding portion 21 and the covering portion 22 cover the legs, torso, and arms of the user when the user wears the main garment member 20. The main garment member 20 is designed to providing protection against flying debris.

Each one of the boot members 40 is integrally attached to an associated leg portion of the main garment member 20. The pair of boot members 40 is designed for covering the feet and ankles of the user when the user wears the main garment member 20.

The hood member 50 includes a visor portion 52 and a hood portion 54. The hood portion 54 is designed for substantially covering the temporal, occipital, parietal and sagittal portions of the head along with the sides and nape of the neck of the user. The visor portion 52 is designed for substantially covering the face of the user. The hood member 50 is integrally coupled to the main garment member 20.

The light assembly 60 is coupled to a first one of a pair of arm portions 24 of the main garment member 20. The light assembly 60 is designed for providing a visual indication of the users location when the user wears the main garment member 20.

The light assembly 60 comprises a light assembly housing 61, a ON/OFF switch 62, a lamp 63, and a battery 64. The light assembly housing 61 includes a transparent portion 65. The lamp 63 is positioned within the light assembly housing 61 and substantially aligned with the transparent portion 65 of the light assembly housing 61. The battery 64 is positioned within the light assembly housing 61. The ON/OFF switch 62 is in electrical communication with the lamp 63 and the battery 64. The ON/OFF switch 62 includes an ON position such that electrical current flows between the lamp 63 and the battery 64 when the ON/OFF switch 62 is in the ON position. The ON/OFF switch 62 includes an OFF position such that electrical current does not flow between the lamp 63 and the battery 64 when the ON/OFF switch 62 is in the OFF position.

The sound assembly 66 is coupled to a second one of the pair of arm portions 24 of the main garment member 20. The sound assembly 66 is designed for providing an aural indication of the users location when the user wears the main garment member 20.

The sound assembly 66 comprises a sound assembly housing 67, a ON/OFF switch 68, a sound generating member 69, and a battery 70. The sound assembly housing 67 includes plurality of slots 71. The sound generating member 69 is positioned within the sound assembly housing 67 and substantially aligned with the plurality of slots 71 of the sound assembly housing 67. The battery 70 is positioned within the sound assembly housing 67. The ON/OFF switch 68 is in electrical communication with the sound generating member 69 and the battery 70. The ON/OFF switch 68 includes an ON position such that electrical current flows between the sound generating member 69 and the battery 70 when the ON/OFF switch 68 is in the ON position. The ON/OFF switch 68 includes an OFF position such that electrical current does not flow between the sound generating member 69 and the battery 70 when the ON/OFF switch 68 is in the OFF position.

Each one of a plurality of vent members 26 is positioned on the main garment member 20. The vent members 26 are for promoting airflow through the main garment member 20 when the user wears the main garment member 20.

A chest pouch assembly 30 includes a pocket portion 32 and a flap portion 34. The pocket portion 32 is coupled to an outer surface of a chest portion 28 of the main garment member 20. The pocket portion 32 includes an opening. The flap portion 34 includes a first end and a second end. The first end is coupled to the outer surface of the chest portion 28. The second end of flap portion 34 is for covering the opening of the pocket portion 32.

A plurality of survival provisions 36 comprises packages of food 37 water 38, and first aid supplies 39. The survival provisions 36 are positioned within the chest pouch assembly 30.

The covering portion 22 of the main garment member 20 has a substantially reflective outer surface. The reflective outer surface is designed for providing a visual indication of the user's location when the user wears the main garment member 20.

The covering portion 22 includes of a nylon/phenolic honeycomb structure. The covering portion 22 is substantially fire resistant for protecting the user when the user wears then main garment member 20.

Each one of the glove members 75 is designed for covering and substantially conforming to an associated one of a pair of hands and wrists of the user. Each one of the glove members 75 includes a padding portion 76 and a covering portion 77. The padding portion 76 is designed to protect the back of the user's hand. The covering portion 77 is designed for enveloping the padding portion 76 and covering and substantially conforming to the back, palm, fingers, and wrist portions of the associated hand.

The visor portion 52 is comprised of a polycarbonate plastic. The visor portion 52 is substantially impact resistant such that the visor portion 52 provides protection for the face of the user against impact from flying debris.

Each one of the boot members 40 includes a padding portion 42 and a covering portion 44. The padding portion 42 is designed for covering the top of the foot and ankle portion of the user when the user wears the main garment member 20. The covering portion 44 is for enveloping the padding portion 42 and covering and substantially conforming to the top of the foot, the sole of the foot, and the ankle portions of the user.

The main garment member 20 includes a slideable closure 23. The slideable closure 23 extends from a neck portion of the main garment member 20 to a groin portion of the main garment member 20. The slideable closure 23 is designed for allowing the user to enter and exit the main garment member 20.

The main garment member 20 includes a flap portion 25. The flap portion 25 is positioned adjacent a first side of the slideable closure 23. The flap portion 25 includes a first portion of a hook and loop fastener. A complementary second portion of hook and loop fastener is positioned adjacent a second side of the slideable fastener 23 such that the flap portion 25 substantially covers the slideable fastener 23 when the first portion of hook and loop fastener engages the complementary second portion of hook and loop fastener.

The hood member 50 includes a first strap portion 57 and a second strap portion 58. The first strap portion 57 includes a first strap first end. The first strap first end is coupled to an associated first side of the hood member 50. The second strap 58 includes a second strap first end. The second strap first end is coupled to and associated second side of the hood member 50.

The first strap 57 includes a first portion of hook and loop fastener coupled thereto. The second strap 58 includes a complementary second portion of hook and loop fastener coupled thereto. The first 57 and second strap portions 58 are designed for securing the hood member 50 when the user wears the main garment member 20.

In use, the user puts on the main garment member and closes the main garment member using the slideable fastener. The flap portion is placed over the slideable fastener, protecting the slideable fastener from catching on items in the environment and providing fire protection for the slideable closure. The user activates the light and sound assemblies. The user then positions the hood member over their head and secures the hood member using the first and second strap portions. The user then puts the visor in a down position providing protection for the user's face.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A personal protective system comprising:

a main garment member, said main garment member being adapted for covering and substantially conforming to the legs, torso, and arms of a user, said main garment member having a padding portion and a covering portion, said covering portion enveloping said padding portion such that said padding portion and said covering portion cover the legs, torso, and arms of the user when the user wears the main garment member whereby said main garment member is adapted for providing protection against flying debris;

a pair of boot members, each of said boot members being integrally attached to an associated leg portion of said main garment member, said pair of boot members being adapted for covering the feet and ankles of the user when the user wears the main garment member, each of said boot members comprising a padding portion forming an upper section of said boot member for positioning adjacent to an upper surface of the foot of the user and a covering portion forming a lower section of said boot member for positioning adjacent to a lower surface of the foot of the user, said padding portion of said upper section of each of said boot members including a compressible foamed material for protecting an upper surface of the foot of the user, said covering portion of said lower section of each of said boot members being free of said compressible foamed material;

a hood member, said hood member having a visor portion and a hood portion, said hood portion being adapted for substantially covering the temporal, occipital, parietal and sagittal portions of the head along with the sides and nape of the neck of the user, said hood portion having a hood padding portion and a hood covering portion, said hood covering portion enveloping said hood padding portion whereby said hood portion is adapted for providing protection against flying debris, said visor portion being adapted for substantially covering the face of the user, said hood member being integrally coupled to said main garment member;

a pair of glove members, each of said glove members being adapted for covering and substantially conforming to an associated one of a pair of hands and wrists of the user, each of said glove members having a padding portion forming an upper section of said glove member for positioning adjacent to a back of the hand of the user and a covering portion forming a lower section of said glove member for positioning adjacent to a palm of the hand of the user, said padding portion of said upper section of each of said glove members including a compressible foamed material for protecting an upper surface of the hand of the user, said covering portion of said lower section of each of said glove members being free of said compressible foamed material;

wherein the personal protective system includes a light assembly, said light assembly being coupled to a first one of a pair of arm portions of said main garment member, said light assembly being adapted for providing a visual indication of the users location when the user wears said main garment member;

said light assembly comprises a light assembly housing, a ON/OFF switch, a lamp, and a battery, said light assembly housing having a transparent portion, said lamp being positioned within said light assembly housing and substantially aligned with said transparent portion of said light assembly housing, said battery being positioned within said light assembly housing, said ON/OFF switch being in electrical communication with said lamp and said battery, said ON/OFF switch having an ON position such that electrical current flows between said lamp and said battery when said ON/OFF switch being in said ON position, said ON/OFF switch having an OFF position such that electrical current does not flow between said lamp and said battery when said ON/OFF switch being in said OFF position.

2. The personal protective system of claim 1, further comprising:

a sound assembly, said sound assembly being coupled to a second one of said pair of arm portions of said main garment member, said sound assembly being adapted for providing a aural indication of the users location when the user wears said main garment member.

3. The personal protective system of claim 2, wherein said sound assembly comprises a sound assembly housing, a ON/OFF switch, a sound generating member, and a battery, said sound assembly housing having plurality of slots, said sound generating member being positioned within said sound assembly housing and substantially aligned with said plurality of slots of said sound assembly housing, said battery being positioned within said sound assembly housing, said ON/OFF switch being in electrical communication with said sound generating member and said battery, said ON/OFF switch having an ON position such that electrical current flows between said sound generating member and said battery when said ON/OFF switch being in said ON position, said ON/OFF switch having an OFF position such that electrical current does not flow between said sound generating member and said battery when said ON/OFF switch being in said OFF position.

4. The personal protective system of claim 1, further comprising:

a plurality of vent members, each one of said vent members being positioned on said main garment member, said vent members being for promoting airflow through said main garment member when the user wears said main garment member.

5. The personal protective system of claim 1, further comprising:

a chest pouch assembly, said chest pouch assembly having a pocket portion and a flap portion, said pocket portion being coupled to an outer surface of a chest portion of said main garment member, said pocket portion having a opening, said flap portion having a first end and a second end, said first end being coupled to said outer surface of said chest portion, said second end of flap portion being for covering said opening of said pocket portion.

6. The personal protective system of claim 1, further comprising:

a plurality of survival provisions comprising packages of food, water, and first aid supplies, said survival provisions being positioned within said chest pouch assembly.

7. The personal protective system of claim 1, wherein said covering portion of said main garment member has a substantially reflective outer surface, said reflective outer surface being adapted for providing a visual indication of the user's location when the user wears said main garment member.

8. The personal protective system of claim 1, wherein said covering portion has of a nylon/phenolic honeycomb structure, said covering portion being substantially fire resistant for protecting the user when the user wears then main garment member.

9. The personal protective system of claim 1, wherein said visor portion comprises a polycarbonate plastic, said visor portion being substantially impact resistant such that said visor portion providing protection for the face of the user against impact from flying debris.

10. The personal protective system of claim 1, wherein said main garment member has a slideable closure extending from a neck portion of the main garment member to a groin portion of the main garment member, said slideable closure being adapted for allowing the user to enter and exit the main garment member.

11. The personal protective system of claim 10, wherein said main garment member has a flap portion positioned adjacent a first side of said slideable closure, said flap portion having a first portion of a hook and loop fastener, a complementary second portion of hook and loop fastener being positioned adjacent a second side of said slideable fastener such that said flap portion substantially covers said slideable fastener when said first portion of hook and loop fastener engages said complementary second portion of hook and loop fastener.

12. The personal protective system of claim 1, wherein said hood member has a first strap portion and a second strap portion, said first strap portion having a first strap first end, said first strap first end being coupled to an associated first side of said hood member, said second strap portion having a second strap first end, said second strap first end being coupled to and associated second side of said hood member;

said first strap portion having a first portion of hook and loop fastener coupled thereto, said second strap portion having a complementary second portion of hook and loop fastener coupled thereto, said first and second strap portions being adapted for securing said hood member when the user wears said main garment member.

13. A personal protective system comprising:

a main garment member adapted for covering and substantially conforming to the legs, torso, and arms of a user, said main garment member having a padding portion and a covering portion, said covering portion enveloping said padding portion such that said padding portion and said covering portion covering the legs, torso, and arms of the user when the user wears the main garment member, said main garment member being adapted to providing protection against flying debris;

a pair of boot members, each one of said boot members being integrally attached to an associated leg portion of said main garment member, said pair of boot members being adapted for covering the feet and ankles of the user when the user wears the main garment member, each of said boot members comprising a padding portion forming an upper section of said boot member for positioning adjacent to an upper surface of the foot of the user and a covering portion forming a lower section of said boot member for positioning adjacent to a lower surface of the foot of the user, said padding portion of said upper section of each of said boot members including a compressible foamed material for protecting an upper surface of the foot of the user, said covering portion of said lower section of each of said boot members being free of said compressible foamed material;

a hood member having a visor portion and a hood portion, said hood portion being adapted for substantially covering the temporal, occipital parietal and sagittal portions of the head along with the sides and nape of the neck of the user, said visor portion being adapted for substantially covering the face of the user, said hood member being integrally coupled to said main garment member;

a light assembly being coupled to a first one of a pair of arm portions of said main garment member, said light assembly being adapted for providing a visual indication of the users location when the user wears said main garment member;

said light assembly comprising a light assembly housing, a ON/OFF switch, a lamp, and a battery, said light assembly housing having a transparent portion, said lamp being positioned within said light assembly housing and substantially aligned with said transparent portion of said light assembly housing, said battery beino positioned within said light assembly housing, said ON/OFF switch being in electrical communication with said lamp and said battery, said ON/OFF switch having an ON position such that electrical current flows between said lamp and said battery when said ON/OFF switch being in said ON position, said ON/OFF switch having an OFF position such that electrical current does not flow between said lamp and said battery when said ON/OFF switch being in said OFF position;

a sound assembly being coupled to a second one of said pair of arm portions of said main garment member, said sound assembly being adapted for providing a aural indication of the users location when the user wears said main garment member;

said sound assembly comprising a sound assembly housing, a ON/OFF switch, a sound generating member, and a battery, said sound assembly housing having plurality of slots, said sound generating member being positioned within said sound assembly housing and substantially aligned with said plurality of slots of said sound assembly housing, said battery being positioned within said sound assembly housing, said ON/OFF switch being in electrical communication with said sound generating member and said battery, said ON/OFF switch having an ON position such that electrical current flows between said sound generating member and said battery when said ON/OFF switch being in said ON position, said ON/OFF switch having an OFF position such that electrical current does not flow between said sound generating member and said battery when said ON/OFF switch being in said OFF position;

a plurality of vent members, each one of said vent members being positioned on said main garment member, said vent members being for promoting airflow through said main garment member when the user wears said main garment member;

a chest pouch assembly having a pocket portion and a flap portion, said pocket portion being coupled to an outer surface of a chest portion of said main garment member, said pocket portion having a opening, said flap portion having a first end and a second end, said first end being coupled to said outer surface of said chest portion, said second end of flap portion being for covering said opening of said pocket portion;

a plurality of survival provisions comprising packages of food, water, and first aid supplies, said survival provisions being positioned within said chest pouch assembly;

said covering portion of said main garment member having a substantially reflective outer surface, said reflective outer surface being adapted for providing a visual indication of the user's location when the user wears said main garment member;

said covering portion having of a nylon/phenolic honeycomb structure, said covering portion being substantially fire resistant for protecting the user when the user wears then main garment member;

a pair of glove members, each one of said glove members being adapted for covering and substantially conforming to an associated one of a pair of hands and wrists of the user, each of said glove members having a padding portion forming an upper section of said glove member for positioning adjacent to a back of the hand of the user and a covering portion forming a lower section of said glove member for positioning adjacent to a palm of the hand of the user, said padding portion of said upper section of each of said glove members including a compressible foamed material for protecting an upper surface of the hand of the user, said covering portion of said lower section of each of said glove members being free of said compressible foamed material;

said visor portion being comprised of a polycarbonate plastic, said visor portion being substantially impact resistant such that said visor portion providing protection for the face of the user against impact from flying debris;

said main garment member having a slideable closure, said slideable closure extending from a neck portion of the main garment member to a groin portion of the main garment member, said slideable closure being adapted for allowing the user to enter and exit the main garment member;

said main garment member having a flap portion, said flap portion being positioned adjacent a first side of said slideable closure, said flap portion having a first portion of a hook and loop fastener, a complementary second portion of hook and loop fastener being positioned adjacent a second side of said slideable fastener such that said flap portion substantially covers said slideable fastener when said first portion of hook and loop fastener engages said complementary second portion of hook and loop fastener;

said hood member having a first strap portion and a second strap portion, said first strap portion having a first strap first end, said first strap first end being coupled to an associated first side of said hood member, said second strap having a second strap first end, said second strap first end being coupled to and associated second side of said hood member;

said first strap having a first portion of hook and loop fastener coupled thereto, said second strap having a complementary second portion of hook and loop fastener coupled thereto, said first and second strap portions being adapted for securing said hood member when the user wears said main garment member.

* * * * *